US007375268B1

(12) United States Patent
Thornhill

(10) Patent No.: US 7,375,268 B1
(45) Date of Patent: May 20, 2008

(54) MACHINE WITH WHICH STRINGED INSTRUMENTS WILL BE PICKED OR PLUCKED

(75) Inventor: Horace G. "Rusty" Thornhill, Crossville, TN (US)

(73) Assignee: H. G. "Rusty" Thornhill, Crossville, TN (US)

( * ) Notice: Subject to any disclaimer, the term of this patent is extended or adjusted under 35 U.S.C. 154(b) by 0 days.

(21) Appl. No.: 11/345,650

(22) Filed: Feb. 1, 2006

Related U.S. Application Data

(60) Provisional application No. 60/651,905, filed on Feb. 11, 2005.

(51) Int. Cl.
*G10D 3/16* (2006.01)

(52) U.S. Cl. ..... 84/320; 84/321; 84/322; 84/315; 84/316; 84/317

(58) Field of Classification Search ..... 84/322, 84/320, 8
See application file for complete search history.

(56) References Cited

U.S. PATENT DOCUMENTS

| | | | | | |
|---|---|---|---|---|---|
| 401,476 | A * | 4/1889 | Barnes | 84/322 |
| 413,579 | A * | 10/1889 | Stewart | 84/322 |
| 1,296,284 | A * | 3/1919 | Gilman | 84/322 |
| 3,739,681 | A * | 6/1973 | Dunlop | 84/322 |
| 4,020,732 | A * | 5/1977 | Kelly | 84/322 |
| 4,270,433 | A * | 6/1981 | Adamec | 84/322 |
| 4,843,942 | A * | 7/1989 | Ishizuka | 84/322 |
| 4,879,940 | A * | 11/1989 | Pereira | 84/322 |
| 4,993,302 | A * | 2/1991 | Jonathan | 84/322 |
| 5,323,677 | A * | 6/1994 | Knutson | 84/322 |
| 5,973,243 | A * | 10/1999 | Christenson | 84/322 |
| 6,335,477 | B1 * | 1/2002 | Miller | 84/322 |
| 2002/0108483 | A1 * | 8/2002 | Smith | 84/322 |
| 2004/0237754 | A1 * | 12/2004 | Sogabe | 84/322 |
| 2005/0211053 | A1 * | 9/2005 | Ball | 84/322 |
| 2006/0086231 | A1 * | 4/2006 | Sielaff | 84/322 |

* cited by examiner

*Primary Examiner*—Lincoln Donovan
*Assistant Examiner*—Christopher Uhlir

(57) ABSTRACT

A machine for placement on the fingertips of players of stringed instruments with which the strings will picked or plucked. Designed as a set, the two picks do not collide as the musician moves his or her fingers to pick the stringed instrument, The abrasion of the interior of the picks, prevents pick slippage, even when worn comfortably loose, The forefinger pick is designed with a unique diagonal wrap that may be adjusted to fit a range of finger sizes, The middle finger pick is designed with wings that provide a gap which allows the adjacent pick to touch the skin of the middle finger instead of allowing metal to touch metal, The forefinger wrap is placed to avoid the metal of the middle finger pick and instead touch the skin of the middle finger, and The shank (the tip portion) may be adjusted or bent to the conformation desired by any given musician.

6 Claims, 2 Drawing Sheets

MACHINE WITH WHICH STRINGED INSTRUMENTS WILL BE PICKED OR PLUCKED

CROSS REFERENCE TO RELATED APPLICATIONS

This application is based on provisional application Ser. No. 60/651,905, filed on Feb. 11, 2005.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of finger picks and more specifically to a machine for placement on the fingertips of players of stringed instruments with which the strings will be picked or plucked.

Ever since the invention of stringed instruments, musicians have striven for the optimum method of plucking or strumming the strings of their chosen instrument. In the earliest of times, strings could be plucked or strummed with the fingernails of the musician because all strings were made from animal sinew or gut. With the onset of steel strings, it was learned that the fingernails of most musicians who chose to pick finger style would not stand up to the harshness of steel strings. In time, some inventor devised a metal device that was installed on the fingertip and supplanted the fingernail as the chosen method of plucking or strumming finger style.

However, from that time forward, myriad problems have plagued the users of the accessory. Early fingerpicks were comprised of two wraparound wings that were designed to be installed around the fingernail area of the finger. This design, currently still in use and sometimes referred to as the "National" design, usually manufactured from metal or plastic, requires that the picks be squeezed on tightly in order to keep the pick from dislodging and flying off the finger. The tightly installed picks often results in no small amount of pain after only a few minutes of use. Secondarily, because the pick is squeezed onto the fingertip, the rear portion of the pick wrap usually rests against the cuticle of the fingernail. During the picking process, the pressure on the pick face causes the rear of the pick wrap to dig into the cuticle. This very often results in painful hangnails, which have been and still are a constant problem. A less painful but nevertheless a very annoying problem is that of pick collisions during musical performances. This results in a clicking noise that very often disrupts and interferes with recording sessions. These pick collisions also diminish many musician's ability to finesse a musical piece.

Over the years, many designs have been offered as a replacement for that early pick. There have been fingerpicks with double wrap wings and numerous other wrap designs, none of which have completely overcome the problem of pick collisions during musical performances or the problem of hangnails and the pain associated with tightly installed fingerpicks.

The Alaska pick was designed as an attempt to more closely replicate the fingernail. This device was designed to slip over the top portion of the finger and embodies a slot into which the fingernail goes. This is to supposedly counter the torque imposed when the string is plucked. While many of this pick design has been sold to date, they are nevertheless not widely used.

The National design has also been manufactured from plastic. This, however, enjoys limited appeal as the memory in plastic prevents the user from permanently forming the pick to an ideal shape to fit his or her finger. Plastic may be reshaped by heating in hot water, but the process is much more burdensome than reshaping metal picks.

Various fingerpick designs have been manufactured from numerous materials, none of which until now, have truly overcome the challenges associated with the use of fingerpicks.

A musician who is able to pick with fingernails enjoys the ultimate in musical "touch." The tip of the finger as well as the fingernail is able to touch the strings, providing the musician with the ability to add finesse and dynamics to his or her music, a luxury that has been unattainable with fingerpicks. Additionally, while playing with fingernails, the skin of the fingers may touch each other while playing. This adds additional awareness of exactly what the fingers are doing during the process of picking.

The National pick design is designed to be worn around the fingernail region of each finger. This usually results in the picks colliding during play. This not only diminishes the musician's touch, but also results in a clicking sound that is often heard during recording sessions.

The National fingerpick design is inherently unstable when in use. Many musicians are forced to continuously push the picks back onto the fingertip during use, despite the fact that they are installed tightly. Very often, when the tip of the pick catches a string on the top side of the tip of the fingerpick, the pick will fly off, resulting in the ruination of the musical piece.

Until now, no fingerpick designs have been invented with two different shapes, designed specifically to overcome the challenges associated with the national, or old style fingerpicks. The most a musician could have hoped for was purchasing picks of different sizes to accommodate fingers of different sizes, but which were and are the same shape. The device described herein was designed as a set. In that configuration, this device overcomes the four (4) major problems associated with most other fingerpicks.

Some prior patents:

| | | |
|---|---|---|
| 401,476 | Apr. 16, 1889 | Barnes |
| 413,579 | Oct. 22, 1889 | Stewart |
| 1,296,284 | Mar. 4, 1919 | Gilman |
| 3,739,681 | Jun. 19, 1973 | Dunlop |

BRIEF SUMMARY OF THE INVENTION

The primary object of the invention is: The two picks are shaped differently, thereby obviating most collisions during use, offering a more perfect touch during musical performances. Another object of the invention is: each pick is designed to be installed near the first knuckle of the finger for which the given pick was specifically designed.

Another object of the invention is: Because the new style picks are worn above the fingernail and cuticle, hangnails are altogether avoided. This is in part due to the fact that the pressure that is normally exerted by the national style pick against the cuticle is, with this new design, distributed behind the cuticle, against the top of the finger, resulting in comfort for long periods of use.

Another object of the invention is: Because the two picks are shaped differently, they rarely touch during use, thereby offering a more Perfect Touch during the performance of musical pieces.

A further object of the invention is: The inside of the picks is abraded, thereby preventing slippage, this allows the picks to be worn comfortably loose, or snug avoiding the pain associated with tightly installed conventional picks.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a two-part machine for placement on the fingertips of players of stringed instruments with which the strings will be picked or plucked comprising the following: The picks may be manufactured from either thin sheet metal or formed plastic, Designed as a complimentary set, the two picks do not collide as the musician moves his or her fingers to pick the stringed instrument, The abrasion of the interior (portion of the picks that touch the finger) of the picks, prevents the picks from slipping and or being dislodged, even when worn comfortably loose, or snug The forefinger pick is designed with a diagonal wrap that may be adjusted to fit a range of finger sizes, The middle finger pick is designed with wings that provide a gap which allows the adjacent pick or picks to touch the skin of the middle finger instead of metal, The forefinger pick wrap is strategically placed to avoid the metal of the middle finger pick and instead to touch the skin of the middle finger.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The present invention is comprised of two components, a middle finger pick and a forefinger pick. However, because the middle finger pick has a gap on the ring finger side 17, a forefinger pick may also be worn on the ring finger with the same advantage enjoyed by wearing it on the forefinger.

Figure 1:
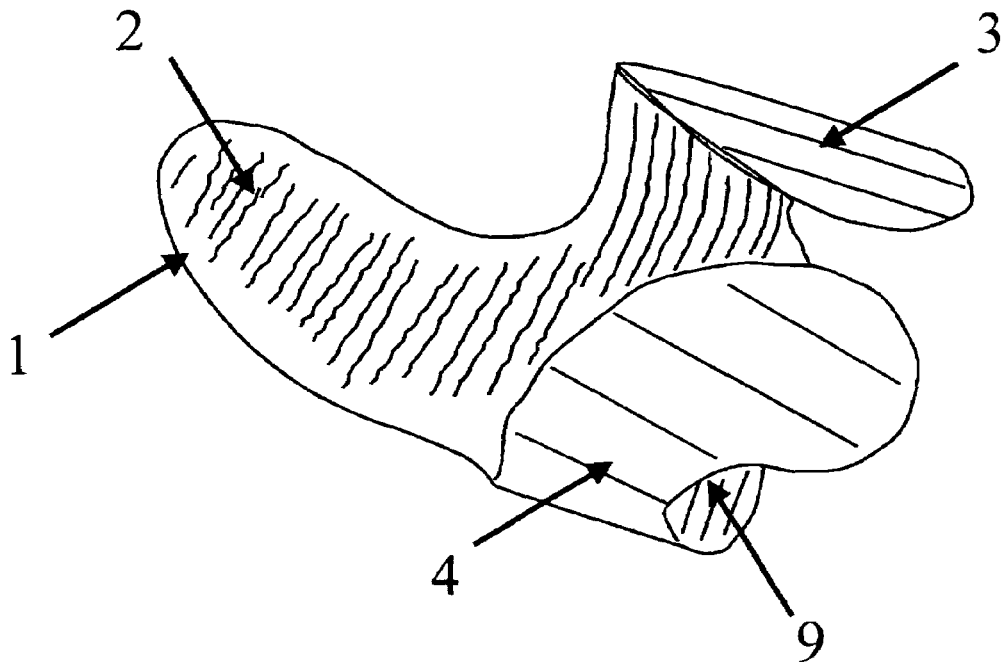
FIG. 1 is a perspective view of the middle finger component of the invention.
Figure 2:
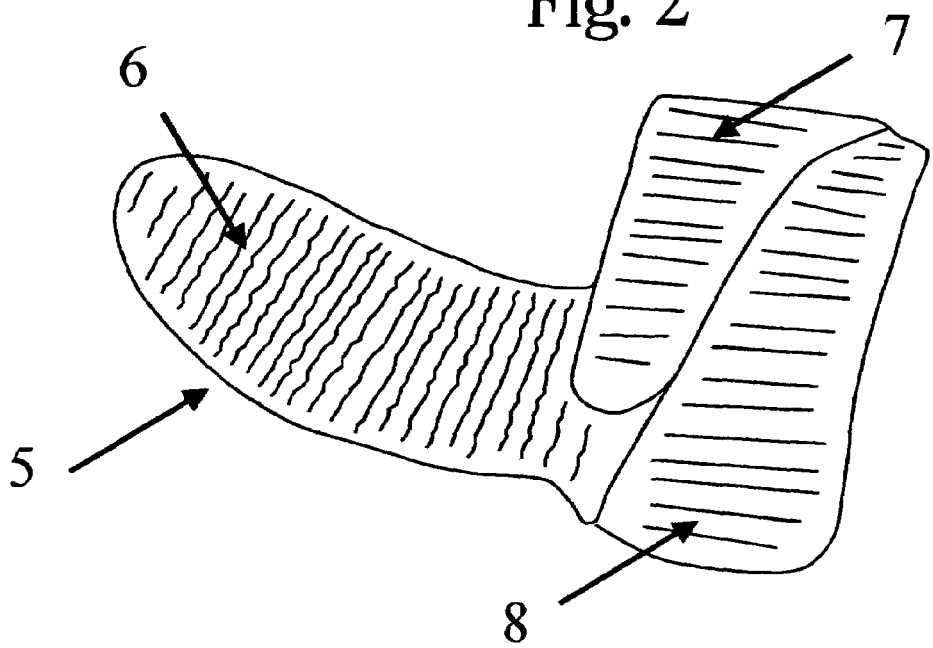
FIG. 2 is a perspective view of the forefinger component of the invention.
Figure 3:
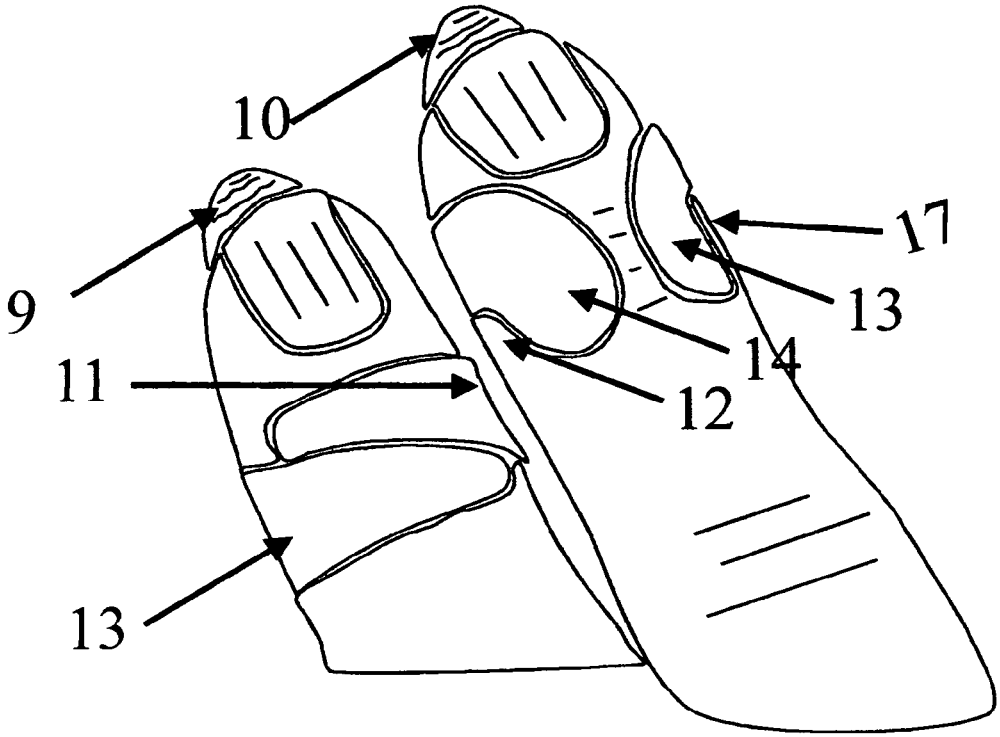
FIG. 3 is a perspective view of the two components of the invention mounted on the appropriate fingers for which they were designed.
Figure 4:
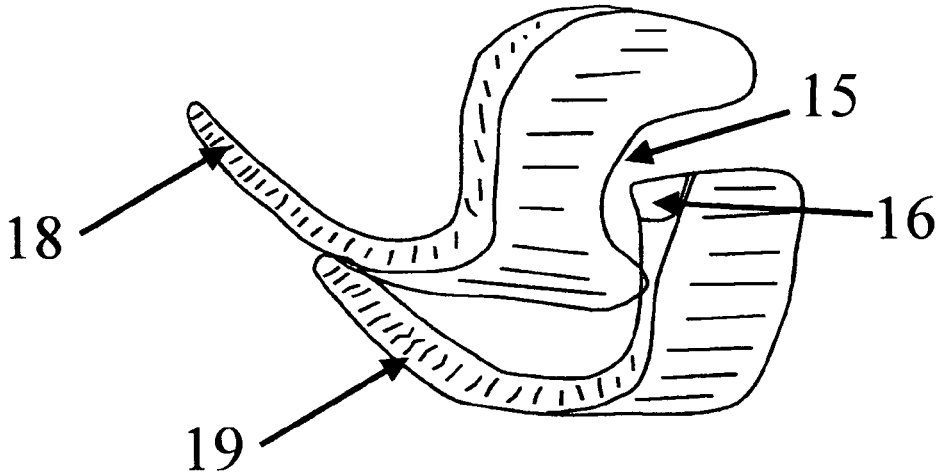
FIG. 4 is a side view of the two components of the invention.

Turning first to FIG. 1, the middle finger pick is comprised of a pick shank 1 with which the strings of the instrument are picked or plucked, two wing wraps 3 & 4, with which the pick is held onto the finger during use, an abraded interior 2 with which slippage of the pick is prevented, a wing gap (both sides of the pick) 9 & 17 which allows the adjacent pick to touch the flesh of the middle finger instead of metal, thereby resulting in a more perfect touch while in use. Turning now to FIG. 2, the forefinger pick is comprised of a pick shank 5 with which the strings of the instrument are picked or plucked, diagonal wraps 7 & 8, with which the pick is held onto the finger during use, an abraded interior 6 with which slippage of the pick is prevented, diagonal wraps 7 or 8, which moves through one or other of the wing gaps on the middle finger pick during use. FIG. 3 depicts the middle finger pick and the forefinger pick installed on their appropriate finger. This view more readily depicts how the wrap of the forefinger pick avoids the metal of the middle finger pick by moving through the gaps 12 and or 17. FIG. 4 is a side view of both components of the present invention. Once again, it is made clear how the diagonal wrap 16 of the forefinger pick moves through the gap 15 of the of the middle finger pick. This view also shows the pick shanks 18 & 19. These may be adjusted by the musician to the desired shape to satisfy the given musician's preference as to how the tip of the pick addresses the strings.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A two-part musical instrument string plucking device, or machine, comprised of:

two main bodies consisting of either metal or plastic, either bent or extruded, so as to fit on specific fingers of musical artisans of stringed instruments;

a first part of said device formed and specifically designed for use on the middle finger of a musician's finger picking hand, either the right or left hand;

a second part of said device formed and specifically designed for use on any one of the other fingers excluding the thumb, but specifically the index finger, ring finger and/or the little finger;

said first part designed with a first wrap that embodies a gap on two sides of the finger; and said second part embodies a unique second wrap that allows the two ends of the wrap to be wrapped past each other without overlapping, such that said second part operates within a gap formed by said first part.

2. The two-part plucking device of claim 1 wherein said first part embodies a gap on opposite sides of the finger, so that part of the skin on opposite sides of the middle finger is exposed within the gaps.

3. The two-part plucking device of claim 1 wherein said second wrap of said second part is designed as a narrow wrap, specifically designed to move adjacent to the gaps in the first part of said device, causing said second wrap of the second part of said device to touch the skin of the middle finger and causing and/or allowing said first wrap of the first portion of the device to touch the skin of the finger not covered by the second wrap of the second part of said device.

4. The two-part plucking device of claim 1 wherein the insides of the first and second wraps, that is to say the portion of the wraps that touch the skin of said first and second part, is abraded in order to prevent slippage of said first and second part of the two-part plucking device during use.

5. The two-part plucking device of claim 1 wherein said two ends of the second wrap are designed with angles that lie opposite each other resulting in optimum adjustability, while maintaining a narrow wrap necessary to operate within the gap of the first part of said device.

6. The two-part plucking device of claim 1 wherein each portion of the two-part plucking device individually embodies a shank or pick face, which engages or plucks the strings of stringed instruments.

* * * * *